US005118910A

United States Patent [19]

Duhon et al.

[11] Patent Number: 5,118,910

[45] Date of Patent: Jun. 2, 1992

[54] ILLUMINATED, PRESSURE-ACTUATED SWITCH

[75] Inventors: Edward W. Duhon, Setauket; Timothy P. DiPeri, Holbrook, both of N.Y.

[73] Assignee: Tapeswitch Corporation of America, Farmingdale, N.Y.

[21] Appl. No.: 491,542

[22] Filed: Mar. 12, 1990

[51] Int. Cl.[5] ..... H01H 13/16

[52] U.S. Cl. ..... 200/86 R; 200/275; 200/310; 340/666; 362/146; 362/251; 362/802

[58] Field of Search ..... 362/146, 95, 251, 802, 362/155, 394; 340/665, 666; 307/119; 200/86 R, 86 A, 86.5, 310, 317, 275, 279, 293, 294, 295, 333

[56] References Cited

U.S. PATENT DOCUMENTS

| | | | |
|---|---|---|---|
| 4,247,747 | 1/1981 | Swatten | 200/314 |
| 4,258,096 | 3/1981 | Lamarche | 200/86 R |
| 4,293,752 | 10/1981 | Koenig | 200/295 |
| 4,425,601 | 1/1984 | Donahue | 362/146 |
| 4,551,595 | 11/1985 | Koenig | 200/279 |
| 4,551,713 | 11/1985 | Aossy | 200/86 R |
| 4,670,725 | 6/1987 | Ahs | 200/275 |
| 4,947,298 | 8/1990 | Stephen | 200/DIG. 35 |

OTHER PUBLICATIONS

Brochure of Luminescent Systems, Inc. of Lebanon, New Hampshire.

The Design Guide to Electroluminescent Lighting Luminescent Systems, Inc., Lebanon, New Hampshire.

*Primary Examiner*—Gerald P. Tolin

*Attorney, Agent, or Firm*—Hoffmann & Baron

[57] ABSTRACT

An illuminated, press-at-any-point switching device which can be actuated by the application of or the removal of pressure at substantially any point along one surface of the switching device.

18 Claims, 3 Drawing Sheets

ILLUMINATED, PRESSURE-ACTUATED SWITCH

The present invention is directed to an illuminated switching device and, more particularly, to an illuminated press-at-any-point pressure-actuated switching device.

BACKGROUND OF THE INVENTION

Electrical switches for opening doors, sounding alarms, and for activating various other devices are well known in the art. In many applications, it is beneficia to provide a switch having an elongated or enlarged actuation surface, i.e. in contrast to a conventional button switch, which can be actuated by applying pressure over a relatively large area of the switch. Such press-at-any-point switches provide advantages in terms of convenience, safety, and flexibility in design.

For certain applications, it would be desirable to provide a press-at-any-point switch which is easy to detect and locate under adverse conditions such as during a smoky fire or in the dark. It would, therefore, be highly desirable to provide an illuminated press-at-any-point switching device. By providing illumination to a press-at-any-point switch, the safety and convenience in many applications may be greatly enhanced.

SUMMARY OF THE INVENTION

The present invention comprises an illuminated, press-at-any-point switching device which can be actuated by the application of or the removal of pressure at substantially any point along at least one surface of the switch. The illumination is preferably provided by a flexible, substantially planar lamp which is disposed at least partially co-extensive with the actuation surface of the switch.

DETAILED DESCRIPTION

Figure 1:
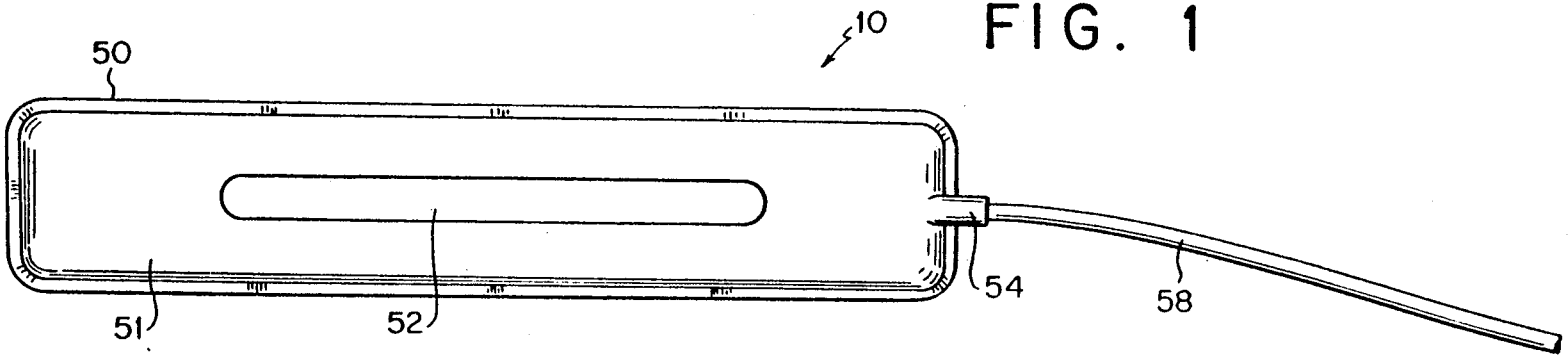
FIG. 1 is a top view of one embodiment of the present invention.

According to one preferred embodiment of the present invention illustrated in FIGS. 1–7, the illuminated, press-at-any-point switching device 10 of the present invention comprises an outer protective envelope 50, an illuminating member 20, and a switching element 30 which is provided with an protective sleeve 31. In this embodiment described in further detail below, each electrically operative element is protected by two moisture-proof barriers in order to provide added protection.

With reference to FIG. 1, which illustrates one embodiment of an illuminated switching device 10 of the present invention, a moisture-proof outer envelope 50 having a front panel 51 and a rear panel 56 are joined along their peripheral edges by heat sealing, e.g. R-F sealing, or any other conventional method. Outer envelope 50 may be opaque and provided with a translucent window 52 or may be formed entirely of a translucent material. Outer envelope 50 is advantageously provided with a reinforced conduit 54 for connecting the internal electrical components of switching 10 device with suitable electrical power sources or controls (not shown) via insulated conductors. Alternatively, the protective outer envelope may be extruded around the switching element 30 and illuminating member 20 described below.

The outer envelope 50 may be formed of moisture-proof materials such as polyvinylchloride. Other suitable materials include impact-resistant polycarbonates such as Lexan TM, a product of the General Electric Company. While the illustrated press-at-any-point switch 100 is elongated and generally rectangular, the present invention is not limited to the illustrated configuration. For example, the present invention can be used to provide an illuminated switching device which is square or which has an irregular shape with dimensions virtually unlimited for practical purposes.

Figure 2:
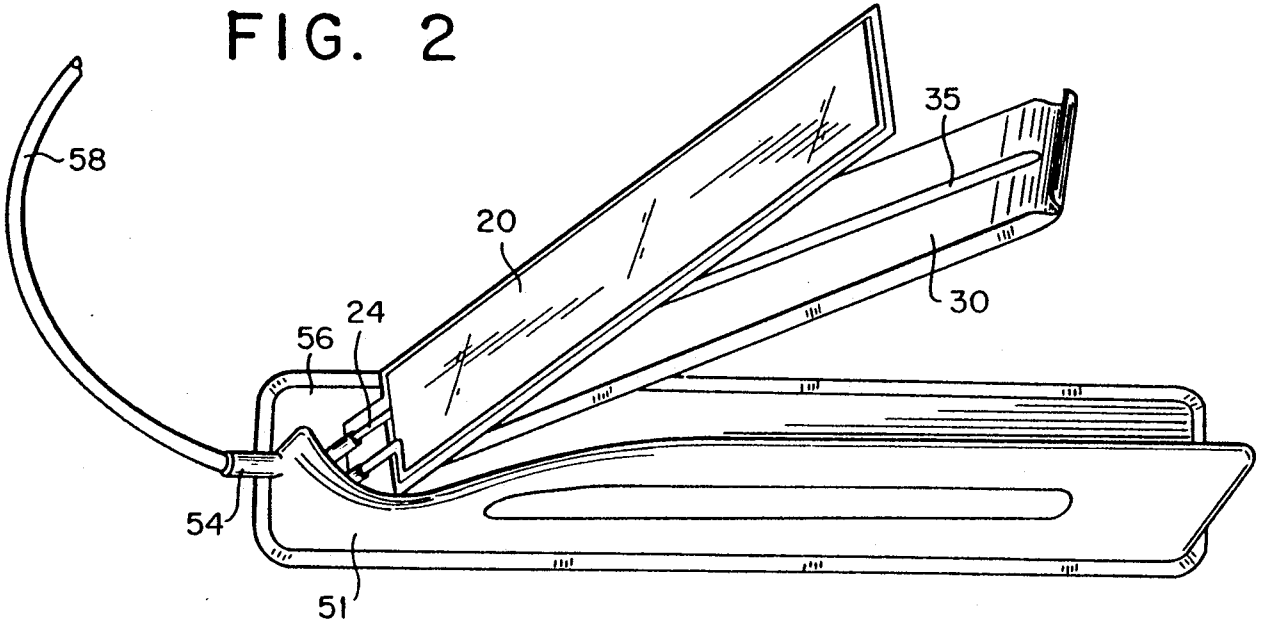
FIG. 2 is a perspective view of the switch shown in FIG. 1 with portions partially removed from the protective envelope thereof.

The illuminating member 20 of one preferred embodiment of the present invention is shown in the illustration of FIG. 2 wherein the top sheet 51 of outer envelope 50 has been separated from bottom sheet 56 and partially peeled away to expose the illuminating member 20 and a press-at-any-point switch 30. While various illuminating members may be used in practicing the present invention, in the preferred illustrated embodiment, the illuminating member 20 is in the form of a flexible, luminescent lamp which receives power through electrical leads 24. The illuminating member 20 is preferably substantially planar and relatively incompressible such that effectively all of the pressure applied to the illuminated switching device 10 is transmitted to the switching member 30. Such thin, flexible lamps are commercially available.

Figure 3:
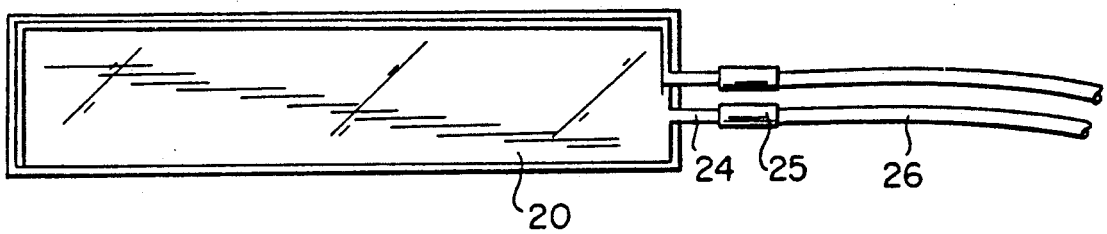
FIG. 3 is a top view of the illuminating member of one embodiment of the present invention.

FIG. 3 clearly shows the location of electrical contacts 24 of the illuminating member 20 illustrated in FIG. 2. Electrical contacts 24 are connected to suitable electrical conductors 26, e.g. copper wires. The points of connection may be enclosed with a suitable protective insulator 25.

The switching element 30 of the present invention may comprise a known pressure-actuated switching arrangement. With reference to FIGS. 4–7, one preferred press-at-any-point switching element 30, which is durable while relatively inexpensive and easy to manufacture, comprises a protective sleeve 31. The sleeve 31 is sealed at both ends thereof to provide additional protection to the electrical elements of the switching member 30 from moisture and environmental effects.

The illustrated switching element 30 also comprises a lower electrically-conductive contact 32 and an upper electrically conductive contact 34 which are separated by electrical insulators 33. The electrically conductive contacts are connected to external sources of power and/or controls via wires 37,39 respectively. The insulators 33 are designed to normally maintain electrical contacts 32,34 in spaced relation thereby preventing electrical communication between the two contacts.

Figure 7A:
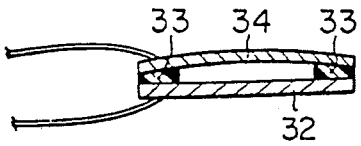
FIGS. 7A and 7B are cross-sectional views taken along lines 7—7 of FIG. 5.
Figure 7B:
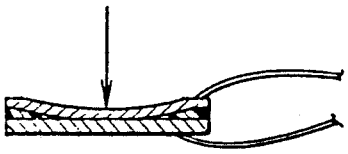
Figure 6:
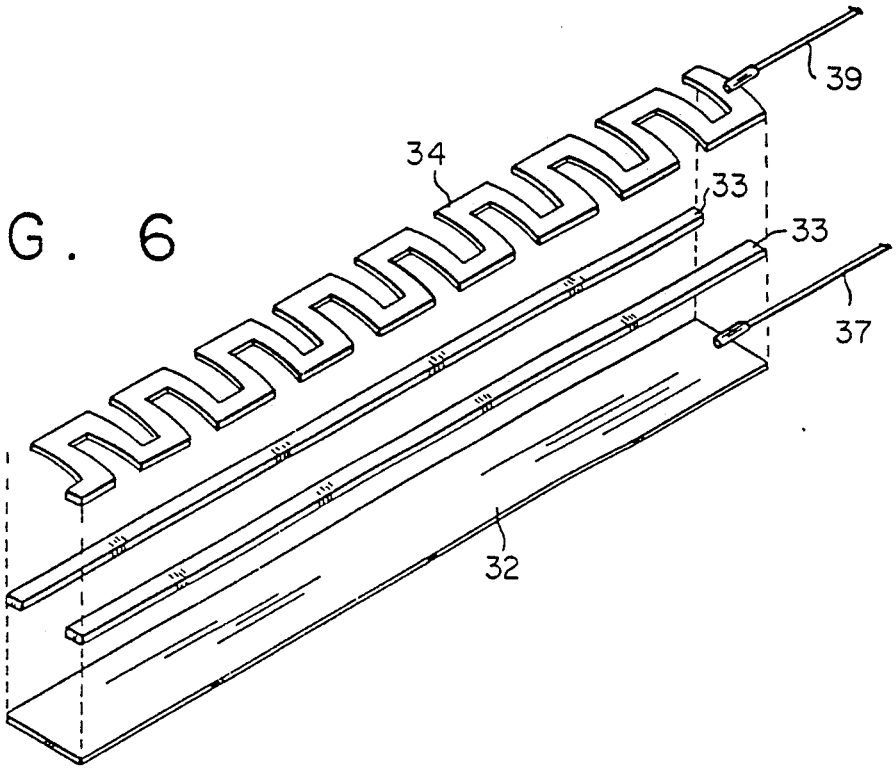
FIG. 6 is an exploded view of the electrically operative elements of the switch shown in FIG. 4.

As shown more clearly in FIGS. 6 and 7(*a*), insulators 33 are preferably disposed between the outer edges of contacts 32,34. In this fashion, when a force is applied to upper contact 34, the upper contact is pushed into lower contact 32 as shown in FIG. 7(*b*), thereby establishing electrical communication between the contacts.

The electrically conductive contacts may be formed of any suitable electrically conductive material such as copper and may be formed in various configurations. It will be appreciated by those skilled in the art that the shape and dimensions of the electrical contacts may vary depending upon the particular application for which the switch is designed. For example, the deformation resistance of the upper electrical contact 34 may be decreased by removing selected portions thereof as shown in the illustrated embodiment. The insulators 33 may also be formed of conventional materials such as rubber, foam or plastics.

Figure 4:
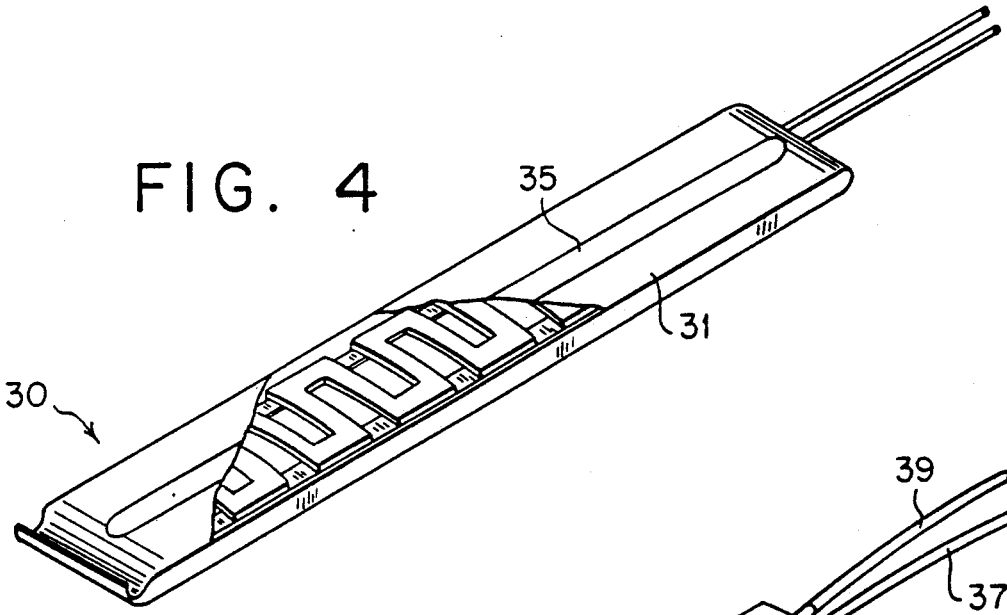
FIG. 4 is perspective view with sections removed of a pressure actuated switch of one embodiment of the present invention.
Figure 5:
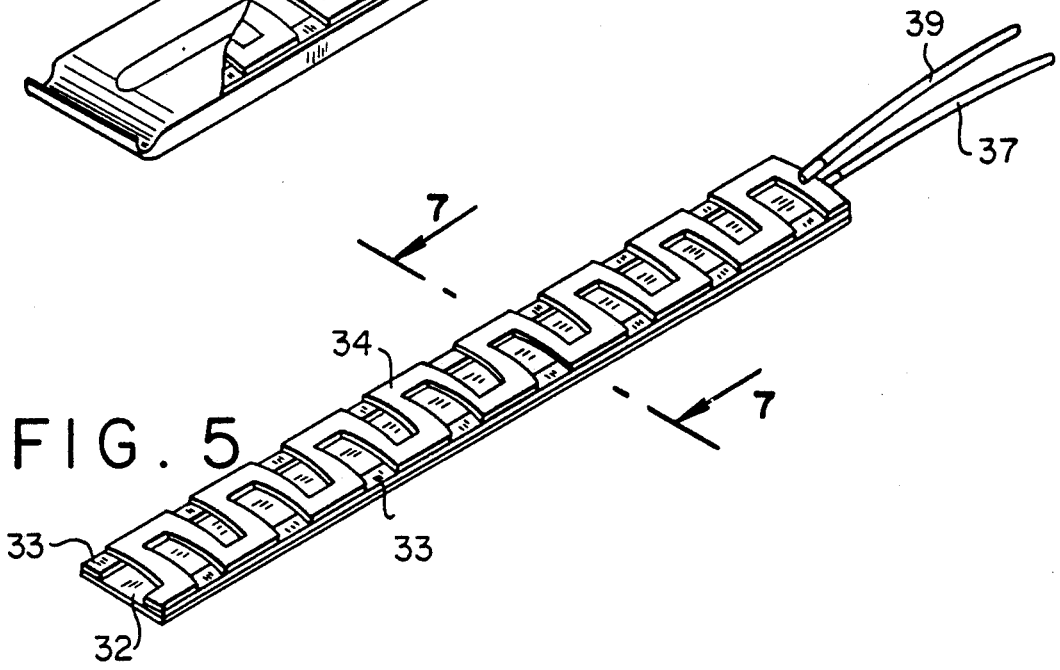
FIG. 5 is a perspective view of the electrically operative elements of the switch shown in FIG. 4.

With reference to FIGS. 2 and 4, protective sleeve 31 may advantageously be provided with a raised bead 35. It will be appreciated by those skilled in the art that the raised bead 35 helps to direct an applied pressure to the center portion of the contacts where the upper contact 34 has greatest resiliency. The cooperation of the bead 35 and relatively incompressible lamp 20 can effectively extend the actuation zone of this embodiment beyond the edges of the switching element 30. As used herein, the term "actuation zone" is meant to indicate the portion or portions of a switching device at which the application of pressure will result in electrical communication between the contacts.

When a less conventional configuration is desired, a plurality of switching elements may be positioned adjacent to one or more lamps within one switching device. Those skilled in the art will appreciate that the positioning of the switching elements is important to insure that the application of pressure to the actuation zone of the switching device will result in an electrical communication between the contacts.

While the idea of providing illumination to a simple electrical switch, such as a doorbell, is well known, the application of an illuminating member which is essentially co-extensive with the actuation surface of a press-at-any-point switch as in this embodiment of the present invention provides benefits not previously contemplated.

Figure 8:
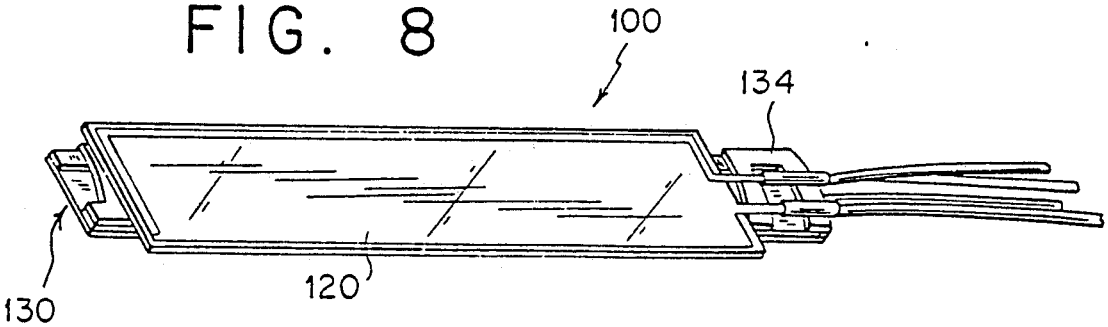
FIG. 8 is a perspective view of another embodiment of the illuminated pressure-actuated switch of the present invention.

In an alternative embodiment of the present invention, a flexible illuminating member may be adhered directly to at least one of the contacts in the manner illustrated in FIG. 8. In accordance with this alternative embodiment, the protective sleeve 31 for the switching element 30 and the outer protective envelope 50 are omitted. As shown in FIG. 8, the illumination member 120 is disposed immediately adjacent to the upper electrically conductive contact of switching element 130. If desired, the illumination member 120 may be secured to the switching member 130 by an adhesive such as a cyanoacrylate or an epoxy adhesive. The embodiment of the present invention illustrated in FIG. 8 is simpler to manufacture than the embodiment 1–7 and is particularly suited for applications wherein the additional protection of an outer envelope and a separate inner protective envelope around the electrical contacts are unnecessary.

We claim:

1. An illuminated, press-at-any-point switching device comprising:

a switching assembly in an elongated actuation zone and comprising a first, flexible electrically-conductive movable contact and a second electrically conductive contact, said first contact movably positioned relative to said second contact;

means for illuminating said actuation zone comprising a substantially planar member movably disposed over said switching assembly, wherein said planar member is a continuous source of light providing constant illumination over said elongated actuation zone, such that pressure applied along a portion of said illuminating means brings said contacts into electrical communication, and means maintaining said illumination means over said actuation zone.

2. A switching device according to claim 1 wherein said illuminating means is disposed adjacent said switching element.

3. A switching device according to claim 1 wherein said maintaining means comprises a protective cover which encloses said switching element and said illuminating means.

4. A switching device according to claim 3 wherein said protective cover comprises plastic.

5. A switching device according to claim 3 wherein said protective cover comprises an impact-resistant polycarbonate.

6. A switching device according to claim 1 wherein said contacts are disposed in close proximity and are normally separated by at least one insulating member.

7. A switching device according to claim 3 further comprising a protective sleeve which encloses said switching element.

8. A switching device according to claim 1 further comprising a protective sleeve which encloses said switching element.

9. A switching device according to claim 1 wherein said illuminating means is adhered directly to at least one of said contacts.

10. A switching device according to claim 1 comprising a plurality of switching elements.

11. An illuminated, press-at-any-point switching device comprising:

an outer, moisture-proof cover having a translucent window defining one end of an actuation zone;

a substantially planar, flexible member disposed under said translucent portion, wherein said planar member is a continuous source of light providing constant illumination over said actuation zone;

a pressure-actuated switching assembly in said actuation zone and comprising a first electrically-conductive contact member and a second electrically-conductive contact member, wherein said first contact is movable relative said second contact and said first contact is positioned under said flexible member such that pressure applied to a portion of said window brings said contacts into electrical communication.

12. A switching device according to claim 11 wherein said planar member is disposed adjacent said switching element.

13. A switching device according to claim 11 wherein said cover encloses said lamp and said switching element.

14. A switching device according to claim 11 wherein said protective cover comprises plastic.

15. A switching device according to claim 11 wherein said protective cover comprises an impact-resistant polycarbonate.

16. A switching device according to claim 11 further comprising a protective sleeve which encloses said switching element.

17. A switching device according to claim 11 wherein said illuminating means is adhered directly to at least one of said contacts.

18. A switching device according to claim 11 comprising a plurality of switching elements.

* * * * *